US009708682B2

(12) United States Patent
Hayakawa et al.

(10) Patent No.: US 9,708,682 B2
(45) Date of Patent: Jul. 18, 2017

(54) PRODUCTION METHOD FOR GRAIN-ORIENTED ELECTRICAL STEEL SHEET

(71) Applicant: JFE STEEL CORPORATION, Tokyo (JP)

(72) Inventors: Yasuyuki Hayakawa, Asakuchi (JP); Yukihiro Shingaki, Kurashiki (JP); Hiroi Yamaguchi, Kurashiki (JP); Hiroshi Matsuda, Chiba (JP); Yuiko Wakisaka, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/650,387

(22) PCT Filed: Dec. 25, 2013

(86) PCT No.: PCT/JP2013/085321
§ 371 (c)(1),
(2) Date: Jun. 8, 2015

(87) PCT Pub. No.: WO2014/104393
PCT Pub. Date: Jul. 3, 2014

(65) Prior Publication Data

US 2015/0299819 A1 Oct. 22, 2015

(30) Foreign Application Priority Data

Dec. 28, 2012 (JP) ..... 2012-288612

(51) Int. Cl.
*C21D 8/12* (2006.01)
*C23C 8/26* (2006.01)
(Continued)

(52) U.S. Cl.
CPC ..... *C21D 8/1261* (2013.01); *C21D 1/26* (2013.01); *C21D 6/001* (2013.01); *C21D 6/002* (2013.01);
(Continued)

(58) Field of Classification Search
CPC ..... C21D 8/1261
See application file for complete search history.

(56) References Cited

U.S. PATENT DOCUMENTS 1,965,559 A 7/1934 Goss
3,333,992 A * 8/1967 Kohler ..... C21D 8/12 148/111
(Continued)

FOREIGN PATENT DOCUMENTS

CN 1242057 A 1/2000
CN 1400319 A 3/2003
(Continued)

OTHER PUBLICATIONS

Jan. 15, 2016 Office Action issued in Korean Patent Application No. 2015-7019245 (with concise statement of relevance).
(Continued)

*Primary Examiner* — Jessee Roe
(74) *Attorney, Agent, or Firm* — Oliff PLC

(57) ABSTRACT

Grain-oriented electrical steel sheets with good magnetic properties are industrially stably produced, by using as the material, a steel slab having a predetermined composition, wherein after cold rolling and before the start of secondary recrystallization annealing, the cold rolled sheet is subjected to nitriding treatment with nitrogen content of 50 mass ppm or more and 1000 mass ppm or less, and a total content of 0.2 mass % to 15 mass % of a sulfide and/or sulfate is contained in an annealing separator, and a staying time in the temperature range of 300° C. to 800° C. in the heating stage
(Continued)

N = 100 mass ppm

N = 500 mass ppm of secondary recrystallization annealing of 5 hours or more is secured to precipitate silicon nitride ($Si_3N_4$) and MnS, and using the silicon nitride in combination with MnS as inhibiting force for normal grain growth to significantly reduce variation of magnetic properties.

5 Claims, 1 Drawing Sheet

(51) Int. Cl.

| | |
|---|---|
| ***C23C 8/50*** | (2006.01) |
| ***C22C 38/60*** | (2006.01) |
| ***H01F 1/16*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/16*** | (2006.01) |
| ***C22C 38/22*** | (2006.01) |
| ***C23C 8/02*** | (2006.01) |
| ***C23C 8/80*** | (2006.01) |
| ***C21D 1/26*** | (2006.01) |
| ***C21D 6/00*** | (2006.01) |
| ***C21D 9/46*** | (2006.01) |
| ***C22C 38/06*** | (2006.01) |
| ***C22C 38/20*** | (2006.01) |
| ***C22C 38/26*** | (2006.01) |
| ***C22C 38/34*** | (2006.01) |
| ***C22C 38/42*** | (2006.01) |
| ***C22C 38/44*** | (2006.01) |
| ***C22C 38/48*** | (2006.01) |
| ***C23C 8/04*** | (2006.01) |
| ***H01F 1/147*** | (2006.01) |
| ***H01F 41/02*** | (2006.01) |

(52) U.S. Cl.

CPC ..... *C21D 6/004* (2013.01); *C21D 6/005* (2013.01); *C21D 6/008* (2013.01); *C21D 8/1222* (2013.01); *C21D 8/1233* (2013.01); *C21D 8/1255* (2013.01); *C21D 8/1272* (2013.01); *C21D 8/1283* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/20* (2013.01); *C22C 38/22* (2013.01); *C22C 38/26* (2013.01); *C22C 38/34* (2013.01); *C22C 38/42* (2013.01); *C22C 38/44* (2013.01); *C22C 38/48* (2013.01); *C22C 38/60* (2013.01); *C23C 8/02* (2013.01); *C23C 8/04* (2013.01); *C23C 8/26* (2013.01); *C23C 8/50* (2013.01); *C23C 8/80* (2013.01); *H01F 1/14783* (2013.01); *H01F 1/16* (2013.01); *H01F 41/02* (2013.01)

(56) References Cited

U.S. PATENT DOCUMENTS

| | | | | |
|---|---|---|---|---|
| 4,255,205 | A * | 3/1981 | Morito | C21D 1/70 148/113 |
| 4,979,997 | A | 12/1990 | Kobayashi et al. | |
| 5,082,509 | A * | 1/1992 | Ushigami | C21D 8/1255 148/111 |
| 5,141,573 | A * | 8/1992 | Nakashima | H01F 1/16 148/111 |
| 5,643,370 | A * | 7/1997 | Huppi | C21D 8/1255 148/111 |
| 2001/0030001 | A1 | 10/2001 | Hayakawa et al. | |
| 2002/0033206 | A1 * | 3/2002 | Cicale' | C21D 8/1255 148/111 |
| 2003/0116236 | A1 * | 6/2003 | Hayakawa | C21D 8/1255 148/516 |
| 2014/0202599 | A1 * | 7/2014 | Watanabe | C21D 8/12 148/579 |

FOREIGN PATENT DOCUMENTS

| | | | |
|---|---|---|---|
| JP | S40-015644 | B | 7/1965 |
| JP | S51-013469 | B | 4/1976 |
| JP | H06-158167 | A | 6/1994 |
| JP | 2782086 | B2 | 7/1998 |
| JP | 2000-129356 | A | 5/2000 |
| JP | 2001-107147 | A | 4/2001 |
| JP | 2006-152364 | A | 6/2006 |
| JP | 2007-314823 | A | 12/2007 |

OTHER PUBLICATIONS

Apr. 8, 2014 International Search Report issued in International Application No. PCT/JP2013/085321.

Sep. 23, 2016 Office Action issued in Chinese Patent Application No. 201380068330.8.

Sep. 23, 2016 Search Report issued in Chinese Patent Application No. 201380068330.8.

Jun. 1, 2016 Office Action issued in Chinese Patent Application No. 201380068330.8.

* cited by examiner

N = 100 mass ppm

N = 500 mass ppm

PRODUCTION METHOD FOR GRAIN-ORIENTED ELECTRICAL STEEL SHEET

TECHNICAL FIELD

The present invention relates to a production method for a grain-oriented electrical steel sheet with excellent magnetic properties which enables obtaining a grain-oriented electrical steel sheet with excellent magnetic properties at low cost.

BACKGROUND

A grain oriented electrical steel sheet is a soft magnetic material used as an iron core material of transformers, generators, and the like, and has a crystal orientation in which the <001> direction, which is an easy magnetization axis of iron, is highly accorded with the rolling direction of the steel sheet. Such microstructure is formed through secondary recrystallization where coarse crystal grains with (110)[001] orientation or the so-called Goss orientation grows preferentially, during secondary recrystallization annealing in the production process of the grain-oriented electrical steel sheet.

Conventionally, such grain-oriented electrical steel sheets have been manufactured by heating a slab containing around 4.5 mass % or less of Si and inhibitor components such as MnS, MnSe and AlN to 1300° C. or higher, and then dissolving the inhibitor components once, and then subjecting the slab to hot rolling to obtain a hot rolled steel sheet, and then subjecting the steel sheet to hot band annealing as necessary, and subsequent cold rolling once, or twice or more with intermediate annealing performed therebetween until reaching final sheet thickness, and then subjecting the steel sheet to primary recrystallization annealing in wet hydrogen atmosphere, and subsequent primary recrystallization and decarburization, and then applying an annealing separator mainly composed of magnesia (MgO) thereon and performing final annealing at 1200° C. for around 5 hours for secondary recrystallization and purification of inhibitor components (e.g. see U.S. Pat. No. 1,965,559A (PTL 1), JPS4015644B (PTL 2) and JPS5113469B (PTL 3))

As mentioned above, in the conventional production processes of grain-oriented electrical steel sheets, precipitates such as MnS, MnSe and AlN precipitates (inhibitor components) are contained in a slab, which is then heated at a high temperature exceeding 1300° C. to dissolve these inhibitor components once, and in the following process, the inhibitor components are finely precipitated to cause secondary recrystallization. As described above, in the conventional production processes of grain-oriented electrical steel sheets, since slab heating at a high temperature exceeding 1300° C. was required, significantly high manufacturing costs were inevitable and therefore recent demands of reduction in manufacturing costs could not be met.

In order to solve the above problem, for example, JP2782086B (PTL 4) proposes a method including preparing a slab containing 0.010% to 0.060% of acid-soluble Al (sol.Al), heating the slab at a low temperature, and performing nitridation in a proper nitriding atmosphere during the decarburization annealing process to form a precipitate of (Al,Si)N during secondary recrystallization to be used as an inhibitor. (Al,Si)N finely disperses in steel and serves as an effective inhibitor. However, since inhibitor strength is determined by the content of Al, there were cases where a sufficient grain growth suppressing effect could not be obtained when the hitting accuracy of Al amount during steelmaking was insufficient. Many methods similar to the above where nitriding treatment is performed during intermediate process steps and (Al,Si)N or AlN is used as an inhibitor have been proposed and, recently, production methods where the slab heating temperature exceeds 1300° C. have also been disclosed.

On the other hand, investigation has also been made on techniques for causing secondary recrystallization without containing inhibitor components in the slab from the start. For example, as disclosed in JP2000129356A (PTL 5), a technique enabling secondary recrystallization without containing inhibitor components, a so-called inhibitor-less method was developed. This inhibitor-less method is a technique to use a highly purified steel and to cause secondary recrystallization by means of texture control.

In this inhibitor-less method, high-temperature slab heating is unnecessary, and it is possible to produce grain-oriented electrical steel sheets at low cost. However, this method is characterized in that, due to the absence of an inhibitor, magnetic properties of the products were likely to vary with temperature variation in intermediate process steps during manufacture. Texture control is an important factor in this technique and, accordingly, many techniques for texture control, such as warm rolling, have been proposed. However, when textures are not sufficiently controlled, the degree to which grains are accorded with the Goss orientation ((110)[001] orientation) after secondary recrystallization tend to be lower compared to when utilizing techniques using inhibitors, resulting in the lower magnetic flux density.

CITATION LIST

Patent Literature

PTL 1: U.S. Pat. No. 1,965,559A
PTL 2: JPS4015644B
PTL 3: JPS5113469B
PTL 4: JP2782086B
PTL 5: JP2000129356A

As mentioned above, with production methods for grain-oriented electrical steel sheets using an inhibitor-less method so far proposed, it was not always easy to stably obtain good magnetic properties.

By using components with Al content reduced to less than 100 ppm, equivalent to inhibitor-less components, avoiding high-temperature slab heating, and performing nitridation to precipitate silicon nitride ($Si_3N_4$) rather than AlN, and further containing a sulfide and/or sulfate in an annealing separator to precipitate MnS, and by inhibiting normal grain growth using the silicon nitride and the MnS, the present invention enables significantly reducing variation of magnetic properties to industrially stably produce grain-oriented electrical steel sheets with good magnetic properties.

SUMMARY

In order to obtain a grain-oriented electrical steel sheet with reduced variation in magnetic properties while suppressing the slab heating temperature, the inventors of the present invention used an inhibitor-less method to prepare a primary recrystallized texture, precipitated silicon nitride thereon by performing nitridation during an intermediate process step, and carried out investigation on using the silicon nitride as an inhibitor.

The inventors inferred that, if it is possible to precipitate silicon, which is normally contained in an amount of several % in a grain-oriented electrical steel sheet, as silicon nitride so as to be used as an inhibitor, a grain growth inhibiting effect would work equally well regardless of the amount of other nitride-forming elements (Al, Ti, Cr, V, etc.) by controlling the degree of nitridation at the time of nitriding treatment.

On the other hand, unlike (Al,Si)N in which Si is dissolved in AlN, pure silicon nitride has poor matching with the crystal lattice of steel and has a complicated crystal structure with covalent bonds. Accordingly, it is known that to finely precipitate pure silicon nitride in grains is extremely difficult. For this reason, it follows that it would be difficult to finely precipitate pure silicon nitride in grains after performing nitridation as in conventional methods.

However, the inventors inferred that, by taking advantage of this characteristic, it would be possible to suppress precipitation of silicon nitride in grains and selectively precipitate silicon nitride at grain boundaries. Further, the inventors believed that, if it is possible to selectively precipitate silicon nitride at grain boundaries, a sufficient grain growth inhibiting effect would be obtained even in the presence of coarse precipitates.

Further, the inventors inferred that, by containing a sulfide and/or sulfate in an annealing separator to form MnS and by using them in combination with silicon nitride, the grain growth inhibiting effect can be further improved.

Based on the above ideas, the inventors conducted intense investigations starting from chemical compositions of the material, and extending to the nitrogen content after nitriding treatment, heat treatment conditions, components of the annealing separator for forming silicon nitride by diffusing nitrogen along grain boundaries, and the like.

As a result, the inventors discovered a new usage of silicon nitride in combination with MnS, and completed the present invention.

Specifically, the primary features of the present invention are as follows.

1. A production method for a grain-oriented electrical steel sheet, the method comprising: subjecting a steel slab to hot rolling, without re-heating or after re-heating, to obtain a hot rolled sheet, the steel slab having a composition consisting of, by mass % or mass ppm, C: 0.08% or less, Si: 2.0% to 4.5% and Mn: 0.5% or less, S: less than 50 ppm, Se: less than 50 ppm, O: less than 50 ppm, sol.Al: less than 100 ppm, N in a range satisfying [sol.Al]×(14/27) ppm≤N≤80 ppm, and the balance being Fe and incidental impurities; then subjecting the hot rolled sheet to annealing and cold rolling to obtain a cold rolled sheet of final sheet thickness; then subjecting the cold rolled sheet to primary recrystallization annealing; then applying an annealing separator thereon; and then subjecting the cold rolled sheet to secondary recrystallization annealing, wherein after cold rolling and before the start of secondary recrystallization annealing, the cold rolled sheet is subjected to nitriding treatment to obtain a nitrogen content of 50 mass ppm or more and 1000 mass ppm or less, a total content of 0.2 mass % to 15 mass % of a sulfide and/or sulfate is contained in an annealing separator, and a staying time in the temperature range of 300° C. to 800° C. in the heating stage of the secondary recrystallization annealing of 5 hours or more is secured, 2. The production method for a grain-oriented electrical steel sheet according to aspect 1, wherein the sulfide and/or sulfate is a sulfide and/or sulfate of one or more of Ag, Al, La, Ca, Co, Cr, Cu, Fe, In, K, Li, Mg, Mn, Na, Ni, Sn, Sb, Sr, Zn and Zr.

3. The production method for a grain-oriented electrical steel sheet according to aspect 1 or 2, wherein the composition of the steel slab further contains, by mass %, one or more of Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50% and Nb: 0.0005% to 0.0100%.

According to the present invention, it is possible to industrially stably produce grain-oriented electrical steel sheets having good magnetic properties with significantly reduced variation, without the need of high-temperature slab heating.

Further, in the present invention, pure silicon nitride which is not precipitated compositely with Al is used compositely with MnS, and therefore when performing purification, it is possible to achieve purification of steel simply by purifying only nitrogen and sulfur, which diffuse relatively quickly.

Further, when using Al or Ti as precipitates as in conventional methods, control in ppm order was necessary from the perspective of achieving desired purification and guaranteeing an inhibitor effect. However, when using Si and S as precipitates during intermediate process steps as in the present invention, such control is completely unnecessary during steelmaking.

BRIEF DESCRIPTION OF THE DRAWINGS

The present invention will be further described below with reference to the accompanying drawings, wherein.

DETAILED DESCRIPTION

Figure 1A:
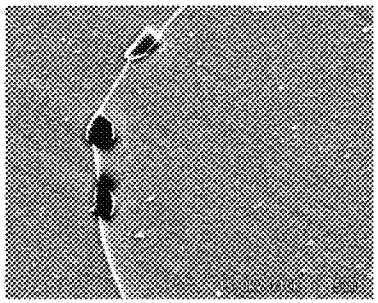
FIG. 1 shows electron microscope photographs of a microstructure subjected to decarburization annealing, followed by nitriding treatment such that the nitrogen content is 100 mass ppm (FIG. 1A) or 500 mass ppm (FIG. 1B), subsequently heated to 800° C. at a predetermined heating rate, and then immediately subjected to water-cooling, as well as a graph (FIG. 1C) showing the identification results of precipitates in the above microstructure obtained by EDX (energy-dispersive X-ray spectrometry).

Details of the present invention are described below.

First, reasons for limiting the chemical compositions of the steel slab to the aforementioned range in the present invention will be explained. Here, unless otherwise specified, indications of "%" and "ppm" regarding components shall each stand for mass % and mass ppm.

C: 0.08% or less

C is a useful element in terms of improving primary recrystallized textures. However, if the content thereof exceeds 0.08%, primary recrystallized textures deteriorate. Therefore, C content is limited to 0.08% or less. From the viewpoint of magnetic properties, the preferable C content is in the range of 0.01% to 0.06%. If the required level of magnetic properties is not very high, C content may be set to 0.01% or less for the purpose of omitting or simplifying decarburization during primary recrystallization annealing.

Si; 2.0% to 4.5%

Si is a useful element which improves iron loss properties by increasing electrical resistance. However, if the content thereof exceeds 4.5%, it causes significant deterioration of cold rolling manufacturability, and therefore Si content is limited to 4.5% or less. On the other hand, for enabling Si to function as a nitride-forming element, Si content needs to be 2.0% or more. Further, from the viewpoint of iron loss properties, the preferable Si content is in the range of 2.0% to 4.5%, Mn: 0.5% or less Since Mn provides an effect of improving hot workability during manufacture, it is preferably contained in the amount of 0.03% or more. However, if the content thereof exceeds 0.5%, primary recrystallized textures worsen and magnetic properties deteriorate. Therefore, Mn content is limited to 0.5% or less.

S, Se and O: less than 50 ppm (individually)

If the content of each of S, Se and O is 50 ppm or more, it becomes difficult to develop secondary recrystallization. This is because primary recrystallized textures are made non-uniform by coarse oxides or MnS and MnSe coarsened by slab heating. Therefore, S, Se and O are all suppressed to less than 50 ppm. The contents of these elements may also be 0 ppm.

sol,Al: less than 100 ppm

Al forms a dense oxide film on a surface of the steel sheet, and could make it difficult to control the degree of nitridation at the time of nitriding treatment or obstruct deearburization. Therefore, Al content is suppressed to less than 100 ppm in terms of sol.Al. However, Al, which has high affinity with oxygen, is expected to bring about such effects as to reduce the amount of dissolved oxygen in steel and to reduce oxide inclusions which would lead to deterioration of magnetic properties, when added in minute quantities during steelmaking. Therefore, in order to curb deterioration of magnetic properties, it is advantageous to add Al in an amount of 20 ppm or more. The content thereof may also be 0 ppm.

$$[\text{sol.Al}]\times(14/27)\text{ppm}\leq N\leq 80\text{ ppm}$$

The present invention has a feature that silicon nitride is precipitated after performing nitridation. Therefore, it is important that N is contained beforehand in steel in an amount equal to or more than the N content required to precipitate as AlN with respect to the amount of Al contained in steel. In particular, since Al and N are bonded at a ratio of 1:1, by containing N in an amount satisfying (sol.Al (mass ppm))×[atomic weight of N (14)/atomic weight of Al (27)] or more, it is possible to completely precipitate a minute amount of Al contained in steel before nitriding treatment. On the other hand, since N could become the cause of defects such as blisters at the time of slab heating, N content needs to be suppressed to 80 ppm or less. The content thereof is preferably 60 ppm or less.

The basic components are as described above. In the present invention, the following elements may be contained according to necessity as components for improving magnetic properties in an even more industrially reliable manner.

Ni: 0.005% to 1.50%

Ni provides an effect of improving magnetic properties by enhancing the uniformity of texture of the hot rolled sheet, and, to obtain this effect, it is preferably contained in an amount of 0.005% or more. On the other hand, if Ni content exceeds 1.50%, it becomes difficult to develop secondary recrystallization, and magnetic properties deteriorate. Therefore, Ni is preferably contained in a range of 0.005% to 1.50%, Sn: 0.01% to 0.50%

Sn is a useful element which improves magnetic properties by suppressing nitridation and oxidization of the steel sheet during secondary recrystallization annealing and facilitating secondary recrystallization of crystal grains having good crystal orientation, and to obtain this effect, it is preferably contained in an amount of 0.01% or more. On the other hand, if Sn is contained in an amount exceeding 0.50%, cold rolling manufacturability deteriorates. Therefore, Sn is preferably contained in the range of 0.01% to 0.50%.

Sb: 0.005% to 0.50%

Sb is a useful element which effectively improves magnetic properties by suppressing nitridation and oxidization of the steel sheet during secondary recrystallization annealing and facilitating secondary recrystallization of crystal grains having good crystal orientation, and to obtain this effect, it is preferably contained in an amount of 0.005% or more. On the other hand, if Sb is contained in an amount exceeding 0.50%, cold rolling manufacturability deteriorates. Therefore, Sb is preferably contained in the range of 0.005% to 0.50%.

Cu: 0.01% to 0.50%

Cu provides an effect of effectively improving magnetic properties by suppressing oxidization of the steel sheet during secondary recrystallization annealing and facilitating secondary recrystallization of crystal grains having good crystal orientation, and to obtain this effect, it is preferably contained in an amount of 0.01% or more. On the other hand, if Cu is contained in an amount exceeding 0.50%, hot rolling manufacturability deteriorates. Therefore, Cu is preferably contained in the range of 0.01% to 0.50%, Cr: 0.01% to 1.50%

Cr provides an effect of stabilizing formation of forsterite films, and, to obtain this effect, it is preferably contained in an amount of 0.01% or more. On the other hand, if Cr content exceeds 1.50%, it becomes difficult to develop secondary recrystallization, and magnetic properties deteriorate. Therefore, Cr is preferably contained in the range of 0.01% to 1.50%.

P: 0.0050% to 0.50%

P provides an effect of stabilizing formation of forsterite films, and, to obtain this effect, it is preferably contained in an amount of 0.0050% or more. On the other hand, if P content exceeds 0.50%, cold rolling manufacturability deteriorates. Therefore, P is preferably contained in a range of 0.0050% to 0.50%.

Mo: 0.01% to 0.50%, Nb: 0.0005% to 0.0100%

Mo and Nb both have an effect of suppressing generation of scabs after hot rolling by for example, suppressing cracks caused by temperature change during slab heating. These elements become less effective for suppressing scabs, however, unless Mo content is 0.01% or more and Nb content is 0.0005% or more. On the other hand, if Mo content exceeds 0.50% and Nb content exceeds 0.0100%, they cause deterioration of iron loss properties if they remain in the finished product as, for example, carbide or nitride. Therefore, it is preferable for each of Mo content and Nb content to be within the above mentioned ranges.

Next, the production method for the present invention will be explained.

A steel slab adjusted to the above preferable chemical composition range is subjected to hot rolling without being re-heated or after being re-heated. When re-heating the slab, the re-heating temperature is preferably approximately in the range of 1000° C. to 1300° C. This is because slab heating at a temperature exceeding 1300° C. is not effective in the present invention where little inhibitor element is contained in steel in the form of a slab, and only causes an increase in costs, while slab heating at a temperature of lower than 1000° C. increases the rolling load, which makes rolling difficult.

Then, the hot rolled sheet is subjected to hot band annealing as necessary, and subsequent cold rolling once, or twice or more with intermediate annealing performed therebetween to obtain a final cold rolled sheet.

The cold rolling may be performed at room temperature. Alternatively, warm rolling where rolling is performed with the steel sheet temperature raised to a temperature higher than room temperature for example, around 250° C. is also applicable.

Then, the final cold rolled sheet is subjected to primary recrystallization annealing.

The purpose of primary recrystallization annealing is to anneal the cold rolled sheet with a rolled microstructure for primary recrystallization to adjust the grain size of the primary recrystallized grains so that they are of optimum grain size for secondary recrystallization. In order to do so, it is preferable to set the annealing temperature of primary recrystallization annealing approximately in the range of 800° C. to below 950° C. Further, by setting the annealing atmosphere during primary recrystallization annealing to an atmosphere of wet hydrogen-nitrogen or wet hydrogen-argon, primary recrystallization annealing may be combined with decarburization annealing.

Further, in the present invention, nitriding treatment is performed after the above cold rolling and before the start of secondary recrystallization annealing. As long as the degree of nitridation is controlled, any means of nitridation can be used and there is no particular limitation. For example, as performed in the past, gas nitriding may be performed directly in the form of a coil using $NH_3$ atmosphere gas, or continuous nitriding may be performed on a running strip. Here, preferable treatment conditions are a treatment temperature of 600° C. to 800° C. and a treatment time of 10 seconds to 300 seconds. Further, it is also possible to utilize salt bath nitriding treatment with higher nitriding ability than gas nitriding. Here, a preferred salt bath is a salt bath of an NaCN—$Na_2CO_3$—NaCl system. Here, the preferable treatment conditions are a salt bath temperature of 400° C. to 700° C. and a treatment time of 10 seconds to 300 seconds.

The important point of the above nitriding treatment is the formation of a nitride layer on the surface layer. In order to suppress diffusion into steel, it is preferable to perform nitriding treatment at a temperature of 800° C. or lower, yet, by shortening the duration of the treatment (e.g. to around 30 seconds), it is possible to form a nitride layer only on the surface even if the treatment is performed at a higher temperature.

Here, it is necessary for the nitrogen content after performing nitridation to be 50 mass ppm or more and 1000 mass ppm or less. If the nitrogen content is less than 50 mass ppm, a sufficient effect cannot be obtained, whereas if it exceeds 1000 mass ppm, an excessive amount of silicon nitride precipitates and secondary recrystallization hardly occurs. Preferably, the nitrogen content is in a range of 200 mass ppm to less than 1000 mass ppm.

After subjecting the steel sheet to the above primary recrystallization annealing and nitriding treatment, an annealing separator is applied on a surface of the steel sheet. In order to form a forsterite film on the surface of the steel sheet after secondary recrystallization annealing, it is necessary to use an annealing separator mainly composed of magnesia (MgO). However, if there is no need to form a forsterite any suitable oxide with a melting point higher than the secondary recrystallization annealing temperature, such as alumina ($Al_2O_3$) or calcia (CaO), can be used as the main component of the annealing separator.

An annealing separator mainly composed of magnesia (MgO) refers to an annealing separator containing magnesia (MgO) of 50 mass % or more, preferably 80 mass % or more.

Here, it is important to contain a sulfide and/or sulfate in an annealing separator in an amount of 0.2 mass % to 15 mass %, in order to form MnS during secondary recrystallization annealing to obtain a grain growth inhibiting effect, thereby increasing the intensity of the Goss orientation which is an ideal orientation of secondary recrystallization.

This is because if the content of a sulfide and/or sulfate in an annealing separator is less than 0.2 mass %, the above effect is not obtained, whereas if the content thereof exceeds 15 mass %, base film formation becomes difficult.

Therefore, the content of a sulfide and/or sulfate in an annealing separator is in the range of 0.2 mass % to 15 mass %. The range is preferably 2 mass % to 10 mass %.

Further, if Cu is contained as a steel component, CuS precipitates as a sulfide in addition to MnS and, as is the case with MnS, contributes to improving the grain growth inhibiting effect.

Further, as a sulfide and/or sulfate to add to an annealing separator, a sulfide and/or sulfate of one or more of Ag, Al, La, Ca, Co, Cr, Cu, Fe, in, K, Li, Mg, Mn, Na, Ni, Sn, Sb, Sr, Zn and Zr is/are preferable.

Subsequently, secondary recrystallization annealing is performed. During this secondary recrystallization annealing, it is necessary to secure a staying time in the temperature range of 300° C. to 800° C. in the heating stage of 5 hours or more. During the staying time, the nitride layer mainly composed of $Fe_2N$, $Fe_4N$ in the surface layer formed by nitriding treatment is decomposed and N diffuses into the steel. As for the chemical composition of the present invention, Al which is capable of forming MN does not remain, and therefore N as a grain boundary segregation element diffuses into steel using grain boundaries as diffusion paths.

Silicon nitride has poor compatibility with steel (i.e. the misfit ratio is high), and therefore the precipitation rate is very low. Nevertheless, since the purpose of precipitation of silicon nitride is to inhibit normal grain growth, it is necessary to have a sufficient amount of silicon nitride selectively precipitated at grain boundaries at the stage of 800° C. at which normal grain growth proceeds. Regarding this point, silicon nitride cannot precipitate in grains, yet by setting the staying time in the temperature range of 300° C. to 800° C. to 5 hours or more, it is possible to selectively precipitate silicon nitride at grain boundaries by allowing silicon to be bound to N and Si diffusing along the grain boundaries. Although an upper limit of the staying time is not necessarily required, performing annealing for more than 150 hours is unlikely to increase the effect. Therefore, the upper limit is preferably set to 150 hours. A more preferable staying time is in a range of 10 hours to 100 hours. Further, as the annealing atmosphere, either of $N_2$, Ar, $H_2$ or a mixed gas thereof is applicable.

After the start of decomposition of a sulfide and/or sulfate during secondary recrystallization annealing, since the diffusion rate of S is lower than N, diffusion proceeds while forming MnS (and further CuS) from the surface layer, and the concentration of S in the surface layer becomes significantly higher than that of nitride. As a result, grain growth in the surface layer is strongly inhibited, and secondary recrystallization starts from the inner parts in the sheet thickness direction. In the surface layer of the steel sheet, a large texture variation is caused due to the frictional force between the surface layer and rolls during hot rolling or cold rolling, and as a result, there is a higher probability of secondary recrystallized grains with displaced orientations being generated. Therefore, by enhancing the grain growth inhibiting effect in the surface layer part, the intensity of the Goss orientation which is an ideal orientation of secondary recrystallization grains is significantly increased compared to nitriding treatment alone, As described above, with a grain-oriented electrical steel sheet obtained by applying the above process to a slab that contains a limited amount of Al in steel, with an excessive amount of N with respect to AlN precipitation added thereto, and contains little inhibitor components such as MnS or MnSe, it is possible to selectively form coarse silicon nitride (with a precipitate size of 100 nm or more), as compared to conventional inhibitors, at grain boundaries at the stage during the heating stage of secondary recrystallization annealing before secondary recrystallization starts, and with the sulfide or sulfate contained in the annealing separator being decomposed and diffused (luring the secondary recrystallization annealing, it is possible to allow MnS (and CuS) to precipitate densely at the surface layer. Although there is no particular limit on the upper limit of the precipitate size of silicon nitride, it is preferably 10 μm or less.

Figure 1B:
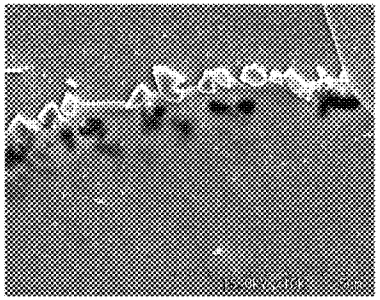
Figure 1C:
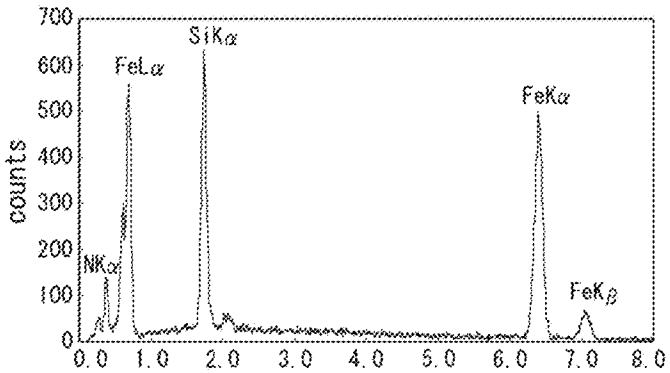

FIG. 1 shows electron microscope photographs for observation and identification of a microstructure subjected to decarburization annealing, followed by nitriding treatment such that the nitrogen content is 100 mass ppm ((a) of FIG. 1) or 500 mass ppm ((b) of FIG. 1), subsequently heated to 800° C. at a heating rate such that the staying time in the temperature range of 300° C. to 800° C. is 8 hours, and then immediately subjected to water-cooling, which were observed and identified using an electron microscope. Further, graph (c) in FIG. 1 shows the results of identification of precipitates in the aforementioned microstructure by EDX (energy-dispersive X-ray spectrometry).

It can be seen from FIG. 1 that unlike fine precipitates conventionally used (with a precipitate size of smaller than 100 nm), even the smallest one of the coarse silicon nitride precipitates at the grain boundary has a precipitate size greater than 100 urn.

The use of pure silicon nitride which is not precipitated compositely with Al which is a feature of the present invention, has significantly high stability from the viewpoint of effectively utilizing Si which exists in steel in order of several % and provides an effect of improving iron loss properties. That is, components such as Al or Ti, which have been used in conventional techniques, have high affinity with nitrogen and provide precipitates which still remain stable at high temperature. Therefore, these components tend to remain in steel insistently, and the remaining components could become the cause of deteriorating magnetic properties.

However, when using silicon nitride, it is possible to achieve purification of precipitates which are harmful to magnetic properties simply by purifying nitrogen and sulfur, which diffuse relatively quickly. Further, when using Al or Ti, control in ppm order is necessary from the viewpoint that purification is eventually required and that an inhibitor effect must surely be obtained. However, when using Si and S, such control is unnecessary during steelmaking, and this is also an important feature of the present invention.

In production, it is clear that utilizing the heating stage of secondary recrystallization is most effective for precipitation of silicon nitride in terms of energy efficiency, yet it is also possible to selectively precipitate silicon nitride at grain boundaries by utilizing a similar heat cycle. Therefore, in production, it is also possible to perform silicon nitride dispersing annealing before time consuming secondary recrystallization.

After the above secondary recrystallization annealing, it is possible to further apply and bake an insulating coating on the surface of the steel sheet. Such an insulating coating is not limited to a particular type, and any conventionally known insulating coating is applicable. For example, preferred methods are described in JPS5079442A and JPS4839338A where a coating liquid containing phosphate-chromate-colloidal silica is applied on a steel sheet and then baked at a temperature of around 800° C.

It is possible to correct the shape of the steel sheet by flattening annealing, and further to combine the flattening annealing with baking treatment of the insulating coating.

EXAMPLES

Example 1

A steel slab having a composition containing C: 0.04%, Si: 3.4%, Mn: 0.08%, S: 0.002%, Se: 0.001%, O: 0.001%, Al: 0.006%, N: 0.0035%, Cu: 0.10%, and Sb: 0.06%, with the balance including Fe and incidental impurities, was heated at 1200° C. for 30 minutes, and then subjected to hot rolling to obtain a hot rolled sheet with a thickness of 2.2 mm. Then, the steel sheet was subjected to annealing at 1065° C. for 1 minute, and subsequent cold rolling to obtain a final sheet thickness of 0.23 mm. Then, samples of the size of 100 mm×400 mm were collected from the center part of the obtained cold rolled coil, and primary recrystallization annealing combined with decarburization was performed in a lab. Then, the samples were subjected to gas treatment or nitriding treatment by salt bath treatment under the conditions shown in Table 1 to increase the nitrogen content in steel.

As the nitriding condition for gas treatment, a mixed atmosphere of $NH_3$: 30 vol % and $N_2$: 70 vol % was used. Further, as the nitriding condition for salt bath treatment, a ternary system salt of NaCN—$Na_2CO_3$—NaCl was used.

The N content of the steel sheet after the above nitriding treatment was measured.

Then, magnesium sulfate was added under the conditions shown in Table 1 to an annealing separator mainly composed of MgO and containing 5% of $TiO_2$ and made into a water slurry state and then applied, dried and baked on the samples, and subsequently, the samples were subjected to final annealing under the conditions shown in Table 1, and then a phosphate-based insulating tension coating was applied and baked thereon to obtain products.

For the obtained products, the magnetic flux density $B_8$ (T) at a magnetizing force of 800 A/m was evaluated.

TABLE 1

| | Nitriding Treatment | | | | N Content | Annealing Separator Additive Amount of Magnesium | Final Annealing Condition Staying Time in Temperature Range | Magnetic | |
|---|---|---|---|---|---|---|---|---|---|
| | Means of Treatment | Content of Treatment | Temperature (° C.) | Time (s) | after Treatment (mass ppm) | Sulfate (mass %) | of 300° C. to 800° C. (h) | Properties $B_8$ (T) | Remarks |
| Condition 1 | None | — | — | — | 35 | 0 | 20 | 1.852 | Comparative Example |
| Condition 2 | Salt Bath | Nitridation | 550 | 120 | 350 | 0 | 20 | 1.913 | Comparative Example |
| Condition 3 | Salt Bath | Nitridation | 550 | 120 | 350 | 5 | 20 | 1.949 | Inventive Example |
| Condition 4 | Salt Bath | Nitridation | 550 | 120 | 350 | 5 | 4 | 1.906 | Comparative Example |
| Condition 5 | Salt Bath | Nitridation | 550 | 600 | 700 | 10 | 20 | 1.940 | Inventive Example |
| Condition 6 | Gas | Nitridation | 750 | 20 | 120 | 0 | 20 | 1.909 | Comparative Example |
| Condition 7 | Gas | Nitridation | 750 | 20 | 120 | 5 | 20 | 1.955 | Inventive Example |
| Condition 8 | Gas | Nitridation | 750 | 80 | 520 | 5 | 20 | 1.958 | Inventive Example |
| Condition 9 | Gas | Nitridation | 750 | 80 | 520 | 10 | 20 | 1.963 | Inventive Example |
| Condition 10 | Gas | Nitridation | 750 | 5 | 40 | 10 | 20 | 1.903 | Comparative Example |
| Condition 11 | Gas | Nitridation | 750 | 3600 | 2900 | 10 | 20 | 1.777 | Comparative Example |

As can be seen in Table 1, it is clear that magnetic properties are improved in the inventive examples compared to those produced in the conventional inhibitor-less manufacturing process.

Example 2

A steel slab containing components shown in Table 2 (the contents of S, Se, and O each being less than 50 ppm) was heated at 1200° C. for 20 minutes, subjected to hot rolling to obtain a hot rolled sheet with a thickness of 2.5 mm, and then the hot rolled sheet was subjected to annealing at 1050° C. for 1 minute, and then cold rolling to obtain a final sheet thickness of 0.27 mm, and then decarburization annealing where the cold rolled sheet is retained at an annealing temperature of 840° C. for 2 minutes, in an atmosphere of $P(H_2O)/P(H_2)=0.4$. Then, some of the coils were subjected to gas nitriding treatment (in an atmosphere of $NH_3$: 30 vol %+$N_2$: 70 vol %) at 750° C. for 20 seconds, and the N content of the steel sheets was measured.

Then, annealing separators, each mainly composed of MgO with 10% of $TiO_2$ and 10% of aluminum sulfate added thereto, were mixed with water, made into slurry state and applied on the steel sheets, respectively, which in turn were wound into coils and then subjected to Final annealing at a heating rate where the staying time in the temperature range of 300° C. to 800° C. was 30 hours. Then, a phosphate-based insulating tension coating was applied and baked thereon, and flattening annealing was performed for the purpose of flattening the resulting steel strips to obtain products.

Epstein test pieces were collected from the product coils thus obtained and the magnetic flux density $B_8$ thereof was measured. The measurement results are shown in Table 2.

TABLE 2

| | Chemical Composition | | | | | | | | Annealing Separator Additive Amount | | |
|---|---|---|---|---|---|---|---|---|---|---|---|
| No. | Si (mass %) | C (mass ppm) | Mn (mass %) | sol. Al (mass ppm) | N (mass ppm) | Others (mass %) | Gas Nitriding Treatment | N Content after Treatment (mass ppm) | of Magnesium Sulfate (mass %) | Magnetic Properties $B_8$ (T) | Remarks |
| 1 | 3.35 | 400 | 0.03 | 180 | 70 | — | Not Performed | 70 | 0 | 1.821 | Comparative Example |
| 2 | 3.35 | 400 | 0.03 | 180 | 70 | — | Performed | 190 | 0 | 1.858 | Comparative Example |
| 3 | 3.35 | 400 | 0.03 | 80 | 20 | — | Not Performed | 20 | 0 | 1.852 | Comparative Example |
| 4 | 3.35 | 400 | 0.03 | 80 | 20 | — | Performed | 140 | 0 | 1.895 | Comparative Example |
| 5 | 3.35 | 400 | 0.03 | 80 | 50 | — | Not Performed | 50 | 0 | 1.885 | Comparative Example |
| 6 | 3.35 | 400 | 0.03 | 80 | 50 | — | Performed | 130 | 8 | 1.951 | Inventive Example |
| 7 | 1.85 | 400 | 0.03 | 80 | 50 | — | Not Performed | 50 | 0 | 1.875 | Comparative Example |
| 8 | 1.85 | 400 | 0.03 | 80 | 50 | — | Performed | 90 | 0 | 1.903 | Comparative Example |
| 9 | 3.35 | 200 | 0.1 | 50 | 20 | — | Not Performed | 20 | 8 | 1.888 | Comparative Example |
| 10 | 3.35 | 200 | 0.1 | 50 | 40 | — | Performed | 150 | 8 | 1.945 | Inventive Example |

TABLE 2-continued

| No. | Chemical Composition Si (mass %) | C (mass ppm) | Mn (mass %) | sol. Al (mass ppm) | N (mass ppm) | Others (mass %) | Gas Nitriding Treatment | N Content after Treatment (mass ppm) | Annealing Separator Additive Amount of Magnesium Sulfate (mass %) | Magnetic Properties $B_8$ (T) | Remarks |
|---|---|---|---|---|---|---|---|---|---|---|---|
| 11 | 3.35 | 600 | 0.08 | 60 | 40 | — | Not Performed | 40 | 0 | 1.878 | Comparative Example |
| 12 | 3.35 | 600 | 0.08 | 60 | 40 | — | Performed | 140 | 8 | 1.948 | Inventive Example |
| 13 | 3.35 | 600 | 0.08 | 60 | 40 | N: 0.01, Sb: 0.02 | Performed | 150 | 8 | 1.955 | Inventive Example |
| 14 | 3.35 | 600 | 0.08 | 60 | 40 | Sn: 0.03 | Performed | 150 | 8 | 1.954 | Inventive Example |
| 15 | 3.35 | 600 | 0.08 | 60 | 40 | Cr: 0.03, Mo: 0.05 | Performed | 140 | 8 | 1.952 | Inventive Example |
| 16 | 3.35 | 600 | 0.08 | 60 | 40 | Cu: 0.05 | Performed | 130 | 8 | 1.950 | Inventive Example |
| 17 | 3.35 | 600 | 0.08 | 60 | 40 | P: 0.01, Nb: 0.001 | Performed | 140 | 8 | 1.953 | Inventive Example |

It can be seen from Table 2 that all of the inventive examples obtained in accordance with the present invention exhibited high magnetic flux density.

Example 3

A steel slab having a composition containing C: 0.03%, Si: 3.3%, Mn: 0.09%, S: 0.003%, Se: 0.001%, O: 0.001%, Al: 0.005%, N: 0.003%, Cu: 0.09% and Sb: 0.05%, with the balance including Fe and incidental impurities, was heated at 1220° C. for 20 minutes, subjected to hot rolling to obtain a hot rolled sheet with a thickness of 2.5 mm. Then, the hot rolled sheet was subjected to annealing at 1050° C. for 1 minute, then cold rolling to obtain a final sheet thickness of 0.27 mm, and then decarburization annealing where the cold rolled sheet was retained at an annealing temperature of 840° C. for 2 minutes, in an atmosphere of $P(H_2O)/P(H_2)=0.4$. Then, after performing salt bath nitriding treatment at 550° C. for 240 seconds (using a ternary system salt of $NaCN—Na_2CO_3—NaCl$), the N content of the steel sheet was measured. The N content was 240 mass ppm.

Then, annealing separators, each mainly composed of MgO with 10% of $TiO_2$ and a sulfide or sulfate added thereto, as shown in Table 3, were mixed with water and made into slurry state and applied on the steel sheets, respectively, which in turn were wound into coils and then subjected to final annealing at a heating rate where the staying time in the temperature range of 300° C. to 800° C. was 30 hours. Then, a phosphate-based insulating tension coating was applied and baked thereon, and flattening annealing was performed for the purpose of flattening the steel strips to obtain products.

Epstein test pieces were collected from the product coils thus obtained and the magnetic flux density $B_8$ thereof was measured. The measurement results are shown in Table 3.

TABLE 3

| No. | Annealing Separator Type of Sulfide, Sulfate | Additive Amount of Sulfide, Sulfate (mass %) | Magnetic Properties $B_8$ (T) | Remarks |
|---|---|---|---|---|
| 1 | None | 0 | 1.872 | Comparative Example |
| 2 | $Ag_2SO_4$ | 10 | 1.965 | Inventive Example |

TABLE 3-continued

| No. | Annealing Separator Type of Sulfide, Sulfate | Additive Amount of Sulfide, Sulfate (mass %) | Magnetic Properties $B_8$ (T) | Remarks |
|---|---|---|---|---|
| 3 | $Al_2(SO_4)_3$ | 10 | 1.963 | Inventive Example |
| 4 | $LaSO_4$ | 10 | 1.955 | Inventive Example |
| 5 | $CaSO_4$ | 10 | 1.955 | Inventive Example |
| 6 | $CoSO_4$ | 10 | 1.952 | Inventive Example |
| 7 | $Cr_2(SO_4)_2$ | 10 | 1.954 | Inventive Example |
| 8 | $CuSO_4$ | 10 | 1.956 | Inventive Example |
| 9 | $FeSO_4$ | 10 | 1.953 | Inventive Example |
| 10 | $In_2(SO_4)_3$ | 10 | 1.965 | Inventive Example |
| 11 | $K_2SO_4$ | 10 | 1.952 | Inventive Example |
| 12 | $Li_2SO_4$ | 10 | 1.955 | Inventive Example |
| 13 | $MgSO_4$ | 10 | 1.962 | Inventive Example |
| 14 | $MnSO_4$ | 10 | 1.961 | Inventive Example |
| 15 | $Na_2SO_4$ | 10 | 1.957 | Inventive Example |
| 16 | $NiSO_4$ | 10 | 1.965 | Inventive Example |
| 17 | $SnSO_4$ | 10 | 1.957 | Inventive Example |
| 18 | $Sb_2(SO_4)_3$ | 10 | 1.958 | Inventive Example |
| 19 | $SrSO_4$ | 10 | 1.955 | Inventive Example |
| 20 | $ZnSO_4$ | 10 | 1.952 | Inventive Example |
| 21 | $Zr(SO_4)_2$ | 10 | 1.950 | Inventive Example |
| 22 | MgS | 10 | 1.963 | Inventive Example |
| 23 | MnS | 10 | 1.955 | Inventive Example |
| 24 | $Na_2S_2O_3$ | 10 | 1.956 | Inventive Example |

It can be seen from Table 3 that all of the inventive examples obtained in accordance with the present invention exhibited high magnetic flux density.

The invention claimed is:

1. A production method for a grain-oriented electrical steel sheet, the method comprising: subjecting a steel slab to hot rolling, without re-heating or after re-heating, to obtain a hot rolled sheet, the steel slab having a composition containing, by mass % or mass ppm, C: 0.08% or less, Si: 2.0% to 4.5% and Mn: 0.5% or less, S: less than 50 ppm, Se: less than 50 ppm, O: less than 50 ppm, sol.Al: 80 ppm or less, N in a range satisfying $[sol.Al]\times(14/27)$ ppm$\leq N\leq 80$ ppm, and the balance being Fe and incidental impurities; then subjecting the hot rolled sheet to annealing and cold rolling to obtain a cold rolled sheet of final sheet thickness; then subjecting the cold rolled sheet to primary recrystallization annealing; then applying an annealing separator thereon; and then subjecting the cold rolled sheet to secondary recrystallization annealing, wherein after cold rolling and before the start of secondary recrystallization annealing, the cold rolled sheet is subjected to nitriding treatment to obtain a nitrogen content of 50 mass ppm or more and 1000 mass ppm or less, the annealing separator contains 50 mass % or more of MgO and a total content of 0.2 mass % to 15 mass % of a sulfide and/or sulfate, and a staying time in the temperature range of 300° C. to 800° C. in the heating stage of the secondary recrystallization annealing of 5 hours or more is secured.

2. The production method for a grain-oriented electrical steel sheet according to claim 1, wherein the sulfide and/or sulfate is a sulfide and/or sulfate of one or more of Ag, Al, La, Ca, Co, Cr, Cu, Fe, In, K, Li, Mg, Mn, Na, Ni, Sn, Sb, Sr, Zn and Zr.

3. The production method for a grain-oriented electrical steel sheet according to claim 1, wherein the composition of the steel slab further contains, by mass %, one or more of Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50% and Nb: 0.0005% to 0.0100%.

4. The production method for a grain-oriented electrical steel sheet according to claim 2, wherein the composition of the steel slab further contains, by mass %, one or more of Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50% and Nb: 0.0005% to 0.0100%.

5. The production method for a grain-oriented electrical steel sheet according to claim 1, wherein the total content of the sulfide and/or sulfate contained in the annealing separator is 2 mass % to 15 mass %.

* * * * *